US011705621B2

(12) United States Patent
Scordilis et al.

(10) Patent No.: US 11,705,621 B2
(45) Date of Patent: Jul. 18, 2023

(54) ANTENNA DEVICE

(71) Applicant: The Swatch Group Research and Development Ltd, Marin (CH)

(72) Inventors: Thierry Scordilis, Cormondrèche (CH); Zoran Randjelovic, Corcelles (CH); Jean Gorisse, Neuchâtel (CH)

(73) Assignee: The Swatch Group Research and Development Ltd, Marin (CH)

( * ) Notice: Subject to any disclaimer, the term of this patent is extended or adjusted under 35 U.S.C. 154(b) by 97 days.

(21) Appl. No.: 17/376,363

(22) Filed: Jul. 15, 2021

(65) Prior Publication Data

US 2022/0077570 A1 Mar. 10, 2022

(30) Foreign Application Priority Data

Sep. 9, 2020 (EP) ..... 20195194

(51) Int. Cl.

| | |
|---|---|
| ***H01Q 1/27*** | (2006.01) |
| ***H01Q 5/307*** | (2015.01) |
| ***G04G 17/04*** | (2006.01) |
| ***G04G 21/04*** | (2013.01) |
| ***H01Q 1/52*** | (2006.01) |

(52) U.S. Cl.

CPC ..... *H01Q 1/273* (2013.01); *G04G 17/04* (2013.01); *G04G 21/04* (2013.01); *H01Q 1/528* (2013.01); *H01Q 5/307* (2015.01)

(58) Field of Classification Search

CPC ..... H01Q 1/273; H01Q 1/528; H01Q 5/307; G04G 17/04; G04G 21/04

See application file for complete search history.

(56) References Cited

U.S. PATENT DOCUMENTS

2011/0013491 A1* 1/2011 Fujisawa ..... G04R 60/08 368/205
2016/0139564 A1* 5/2016 Tsushima ..... G04R 60/04 368/282

(Continued)

FOREIGN PATENT DOCUMENTS

| | | |
|---|---|---|
| CN | 204947065 U | 1/2016 |
| CN | 106707729 A | 5/2017 |
| CN | 107077102 A | 8/2017 |

(Continued)

OTHER PUBLICATIONS

Japanese Office Action dated May 10, 2022 in Japanese Patent Application No. 2021-105339 (with English translation), 8 pages.

(Continued)

*Primary Examiner* — Daniel Munoz

(74) *Attorney, Agent, or Firm* — Oblon, McClelland, Maier & Neustadt, L.L.P.

(57) ABSTRACT

A timepiece including a case formed of a metal middle part wherein are disposed a metal dial and a remote communication system provided with a multi-band antenna device arranged above the dial, the communication system including a bracelet of the timepiece connected at its ends to the middle part and including a body formed of a plurality of fastening elements having different electrical conduction properties, the arrangement of the fastening elements in the body of the bracelet being configured to achieve an enlargement of the radiation pattern of the antenna device.

13 Claims, 3 Drawing Sheets

(56) References Cited

U.S. PATENT DOCUMENTS

| | | | | |
|---|---|---|---|---|
| 2017/0033439 | A1* | 2/2017 | Liu | H01Q 1/243 |
| 2018/0173167 | A1 | 6/2018 | Szini et al. | |

FOREIGN PATENT DOCUMENTS

| | | | |
|---|---|---|---|
| CN | 111 029 731 | A | 4/2020 |
| CN | 110994131 | A | 4/2020 |
| EP | 1 315 052 | A1 | 5/2003 |
| JP | 2010-230374 | A | 10/2010 |
| JP | 2012-244454 | A | 12/2012 |
| JP | 2015-179928 | A | 10/2015 |
| JP | 2020-57931 | A | 4/2020 |
| WO | WO 2020/129352 | A1 | 6/2020 |

OTHER PUBLICATIONS

European Search Report dated Feb. 12, 2021 in European Application 20195194.4, filed on Sep. 9, 2020 (with English Translation of Categories of cited documents), 3 pages.

Combined Office Action and Search Report dated Dec. 23, 2022 in Chinese Patent Application No. 202111042774.7 (with English Translation of Office Action Only), 11 pages.

* cited by examiner

ANTENNA DEVICE

CROSS-REFERENCE TO RELATED APPLICATION

This application claims priority to European Patent Application No. 20195194.4 filed on Sep. 9, 2020, the entire disclosure of which is hereby incorporated herein by reference.

TECHNICAL FIELD OF THE INVENTION

The invention relates to an antenna device used in a communication system for a timepiece.

TECHNOLOGICAL BACKGROUND OF THE INVENTION

For several years now, watches have been integrating communication means in order to be able to connect to different communication networks, such as Bluetooth to connect to a mobile terminal, and geolocation, to connect to various satellite positioning systems such as GPS, Glonass or Galileo. For this purpose, a watch integrates one or more antennas.

It is known that the optimum size of an antenna depends directly on the wavelength of the transmitted/received signal. An antenna of optimal length allows a full signal to be sent/received at full power.

In a watch, the available space being limited, an antenna must have an adapted design to fit into the middle part of the watch.

And if the watch incorporates a radio communication means that operates on radio frequencies (such as 2.4 GHz or 1.5 GHz), the size of the product becomes critical relative to the wavelength (120 mm and 200 mm).

Moreover, other constraints must also be taken into account:

- The watch includes a lot of metal parts, in particular its middle part, and an antenna must be isolated therefrom.
- The watch can integrate several communication devices in the same case, as specified above. The watch cannot have a volume exceeding a certain size (maximum diameter of 50 mm as a general rule).

In this context, it is understood that there is a need to find a solution, in particular which does not have the drawbacks of the prior art.

SUMMARY OF THE INVENTION

Under these conditions, one of the purposes of the invention is therefore to have an antenna device intended for use in a communication system for a timepiece, such as a watch, which integrates at least two antenna circuits each having an optimum length to send/receive a full signal and at full power and to fit into the middle part of a watch, the reception volume of which is limited.

To this end, the invention relates to a timepiece comprising a case formed of a metal middle part wherein are disposed a metal dial and a remote communication system provided with a multi-band antenna device arranged above said dial, the communication system comprising a bracelet of said timepiece connected at its ends to said middle part and comprising a body formed of a plurality of fastening elements having different electrical conduction properties, the arrangement of said fastening elements in the body of the bracelet being configured to achieve an enlargement of the radiation pattern of said antenna device.

In other embodiments:

- the fastening elements comprise links which can each be made of metallic material or of dielectric material;
- the dielectric material link is comprised in the body of the bracelet at one of its two ends, intended to be connected to the middle part;
- the number of metallic material links constituting the body of the bracelet contributes to achieving the configuration of the enlargement of the radiation pattern of said antenna device;
- the antenna device includes: a substrate, a first antenna circuit produced on said substrate and having first and second strands having a proximal end and a distal end, and extending in parallel between their proximal and distal ends, the first and second strands being connected by their proximal ends and separated at their distal ends, and/or a second antenna circuit produced on said substrate and having third and fourth strands having a proximal end and a distal end, and extending in parallel between their proximal and distal ends, the third and fourth strands being connected by their distal ends and separated at their proximal ends, an electrical junction link joining the proximal ends of the first and third strands, a connection part configured to be bent relative to said electrical junction link, and including a conductive connection connected to the electrical junction link and including an electromagnetic shielding of said conductive connection;
- said strands are curved;
- the substrate is composed of a first plate having a face on which the two antenna circuits are made, said connection part being configured to be bent relative to said first plate.
- the first plate of the substrate has a circular arc-shaped profile.
- the first and second antenna circuits are disposed on either side of said electrical junction link.
- the remote communication system comprises: the antenna device, and a duplexer/notch circuit connected to said electrical junction link via the conductive connection of the connection part.
- the antenna device is able to simultaneously communicate signals of different polarities and/or signals of different frequency bands.
- said duplexer/notch circuit includes a first communication circuit configured to communicate according to a Bluetooth type protocol and a second communication circuit configured to communicate on a satellite positioning network via the first and second antenna circuits respectively, and
- the timepiece is a connected watch.

BRIEF DESCRIPTION OF THE FIGURES

Other features and advantages of the present invention will emerge more clearly from the following detailed description, made in conjunction with the appended figures listed below.

DETAILED DESCRIPTION OF AN EMBODIMENT OF THE INVENTION

In the remainder of the description, the terms "top", "bottom", "upper", "lower", "above" "below" are to be considered taking into account a horizontal median plane (P) parallel to the horizontal bearing plane of the case of the timepiece on a surface.

Figure 3:
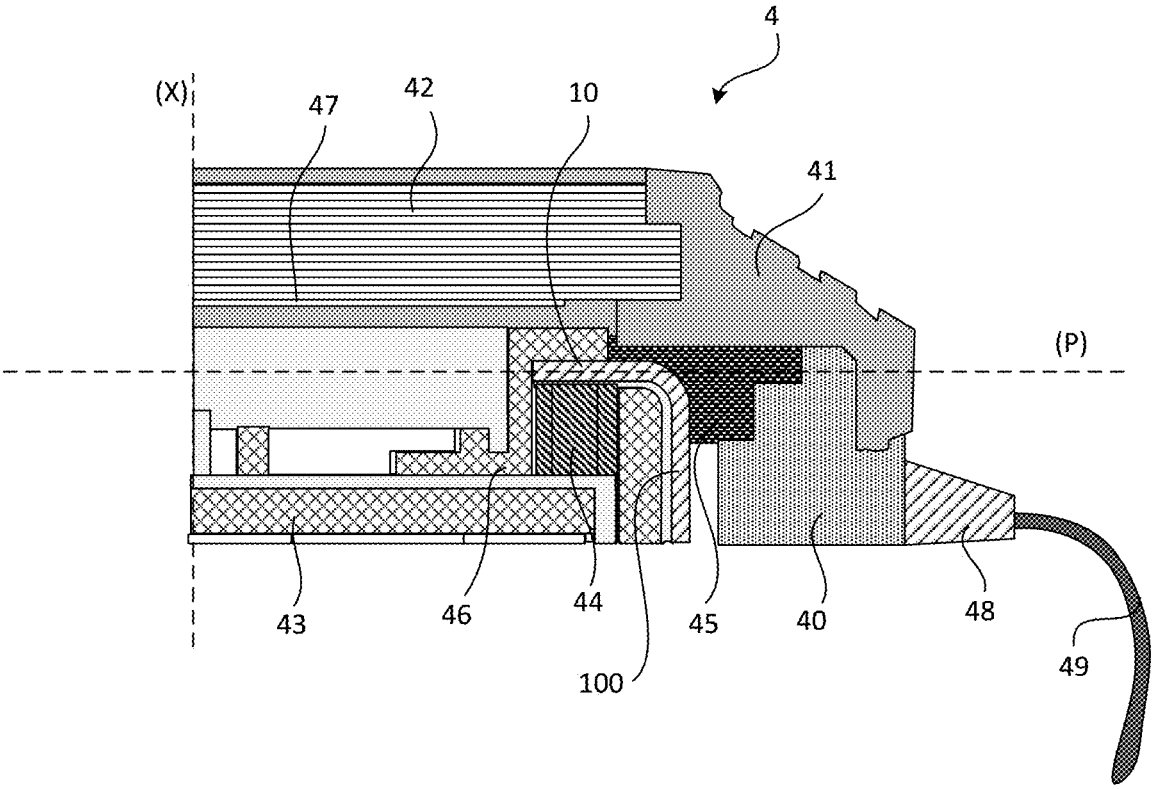
FIG. 3 shows, in a partial sectional view, a timepiece incorporating the antenna device in accordance with the invention.

The terms "outer", "external", "inner" and "internal" are to be understood taking into account a median axis (X) oriented perpendicular to said median plane visible in FIG. 3

Figure 1:
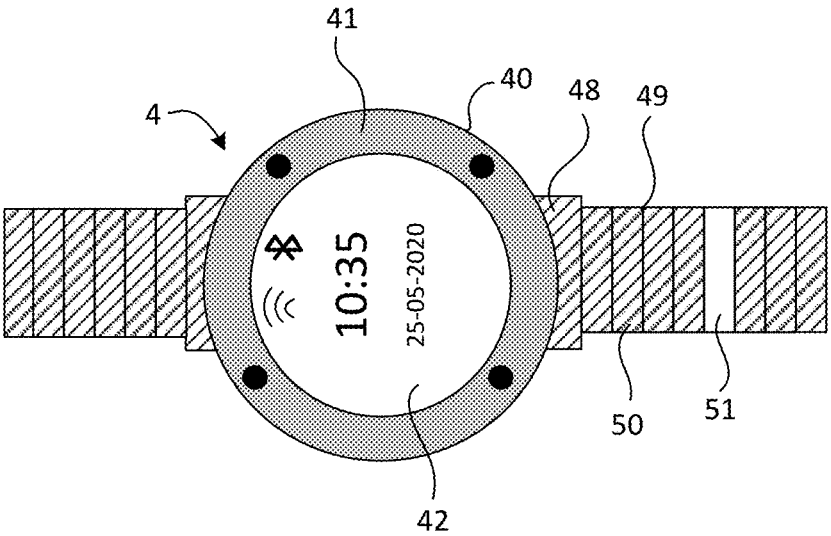
FIG. 1 shows a timepiece comprising a bracelet provided with a plurality of fastening elements here links that can each be made of metallic material or of dielectric material, according to one embodiment of the invention.
Figure 2:
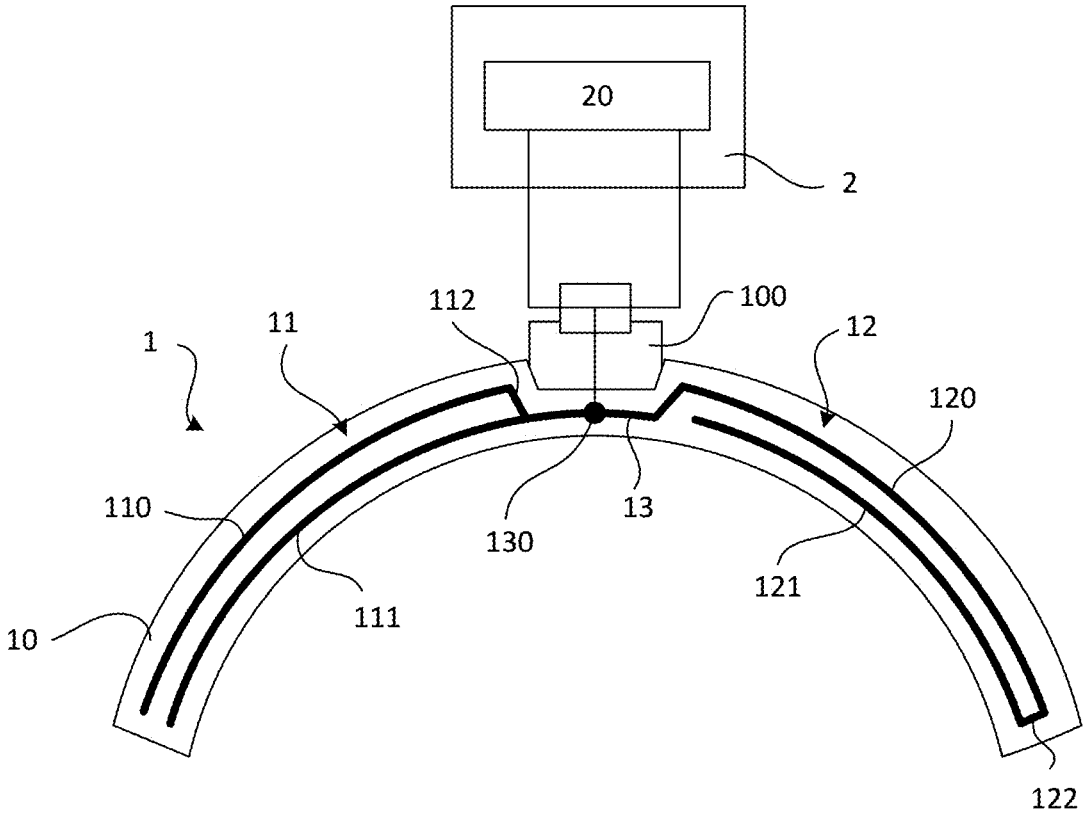
FIG. 2 shows the antenna device in accordance with the invention.

In FIG. 1, the timepiece 4 comprises a case formed of a middle part 40 wherein are disposed a metal dial and a remote communication system provided with a multi-band antenna device 1 visible in FIG. 2. As will be seen below, this timepiece 1 comprises a bracelet 49 provided with a body formed of a plurality of fastening elements 50, here links, having different electrical conduction properties and the arrangement of which in this body contributes to achieving the configuration of the enlargement of the radiation pattern of said antenna device 1.

The fastening elements 50 are essential elements for achieving the function of fastening the watch to the wrist of the wearer as is conventionally expected of a watch bracelet. They can also be called "essential fastening elements" of the bracelet. In other words, for a bracelet formed of leather strands and an antenna structure mounted in the body of one and/or the other of these strands or else on an internal or external surface of the body of one and/or the other of these strands, only these strands are in this example essential fastening elements. Indeed, a bracelet devoid of these strands and therefore comprising only the antenna structure is not able to perform the function of fastening to the wrist of the wearer of the watch as could be achieved by a bracelet comprising the strands.

Referring to FIG. 2, the case of a timepiece 4 includes a reception volume defined by a middle part 40, generally made of metallic material, forming its side wall around said median axis, made in a single part or in two parts with an upper bezel 41, for example made of ceramic or titanium. The reception volume of the timepiece 4 is closed from above by means of a glass 42, for example made of sapphire crystal, supported by the middle part 40 and sealingly fixed thereto by an adapted method. The timepiece also includes a back wall (not visible), for example metallic back wall, located opposite its glass 42 relative to the median plane, advantageously isolated from the middle part by a seal, closing off the reception volume from below.

According to a particular aspect of the invention, the timepiece 4 includes a communication system which mainly includes:

- A communication antenna device 1 and,
- A duplexer/notch type filter circuit 20, known per se to the person skilled in the art.

The antenna device 1 includes a substrate 10, advantageously produced in the shape of a flexible printed circuit (commonly called "flex").

With reference to FIG. 2, the antenna device 1 has the particularity of including two distinct antenna circuits, to allow the timepiece to be connected to two distinct networks, more specifically a communication network of the Bluetooth type and a GNSS (Geolocation and Navigation Satellite System) satellite positioning network, such as for example the GPS (Global Positioning System), Glonass or Galileo.

In this configuration, this antenna device 1 is able to simultaneously communicate signals of different polarities and/or signals of different frequency bands.

The two antenna circuits are produced on the same substrate by standard methods used in the field of printed circuits.

According to a particular aspect of the invention:

- The first antenna circuit 11 has a first strand 110 and a second strand 111 which each include a proximal end and a distal end, and which extend in parallel between their proximal and distal ends, the first and second strands being connected 112 by their proximal ends and separated at their distal ends;
- The second antenna circuit 12 has a third strand 120 and a fourth strand 121 which each include a proximal end and a distal end, and which extend in parallel between their proximal and distal ends, the third and fourth strands being connected 122 by their distal ends and separated at their proximal ends;

An electrical connection 13 allows to connect the proximal ends of the first, second and third strands 110, 11, 120. This electrical connection 13 includes a single connection point 130 to which said filtering circuit 2 is connected. A single connection point 130 will thus allow to communicate by selectively using the first and second antenna circuits 11 and 12.

The architecture with two parallel strands of the first antenna circuit 11 allows to enlarge the frequency band (100 MHz), necessary for example to communicate on a Bluetooth-type communication network (2.4 GHz).

For the second antenna circuit 12 (for example dedicated to a satellite positioning circuit), the antenna is supplied on a current node and its length is bent, allowing to improve the impedance matching.

The single connection point 130 for the two antenna circuits 11, 12 in parallel allows to facilitate the mechanical integration of the antenna device in the reception volume of the timepiece 4 as well as a design independence between the antenna part and the electronic part. Indeed, it suffices to adjust the mechanical integration of the support plate of these antenna circuits in the construction, the pattern of the antenna circuits being produced subsequently by a standard etching method that does not compromise said mechanical integration. The second antenna circuit 12 with two strands connected in series allows to communicate on a narrower frequency band, for example at 1.5 GHz used to communicate on a satellite positioning network (for example GPS). It will be noted that this antenna device 1 is capable of simultaneously communicating signals of different polarities and/or of different frequency bands.

In this configuration, each antenna circuit 11, 12 extends essentially along a circular arc-shaped path including two strands 110, 111, 120, 121 arranged in parallel on the substrate 10 which follow this path.

For example, each antenna circuit 11, 12 can be produced over an angular range comprised between 70 and 80° relative to the angle of the angular sector which defines the arc of a circle formed by this antenna circuit 11, 12 on either side of the central junction link. Their trajectory can follow this arc of a circle made along a radius comprised between 16 and 22 mm. The two strands 110, 111, 120, 121 can be separated from each other by a distance comprised between 1 and 2 mm.

The substrate 10 is in the shape of a first plate having a profile produced in an arc of a circle, advantageously in a semicircle. This configuration greatly helps to obtain circular polarisation for satellite antennas in particular. This configuration also helps with the implementation of the Bluetooth protocol, as the waves propagate in closed places such as living rooms. The two antenna circuits are printed on the same face of the plate, its upper face, and each extend on either side of a separation part carrying the electrical connection 13 joining the two antenna circuits 11, 12. This separation part is advantageously median, separating the substrate into two arcs of a circle of substantially equal or even equal or strictly equal dimensions.

The antenna device further includes a connection part 100, in the shape of a protuberance of the plate.

When integrating the substrate 10 into the middle part 40 of the timepiece 4, the connection part 100 of the substrate 10 is intended to be bent relative to the first plate, around an axis perpendicular to the axis (X) and parallel to the plane (P).

This connection part 100 includes one or more conductive connections allowing to connect the antenna circuits 11, 12 (at the electrical connection 13) to an electronic control circuit 2 carrying the duplexer/notch type filter circuit 20. The connection part 100 includes an electromagnetic shielding of these conductive connections to prevent any radiation to the outside and to allow to prevent the connection part 100 from influencing the impedance of the antenna circuits 11 and 12. For example, the shielding can be achieved by assembling several superimposed layers: a lower shielding layer, an insulating layer, a layer integrating the conductive connections, then a new insulating layer and a new upper shielding layer.

A control card carrying the electronic control circuit 2 (the control circuit 2 carrying for example one or more RF transmitting/receiving circuits and of a design known per se) can be arranged in the bottom of the case of the timepiece 4.

The antenna device 1 is connected to the control card, by the connection part 100 via the conductive connection(s).

Referring to FIG. 3, in its reception volume, the timepiece 4 can incorporate a dial 43, advantageously made of metal, located above the back wall. This dial may bear aesthetic indications visible through the glass of the timepiece. It advantageously has the shape of a disc.

The timepiece can incorporate a wedge 44 arranged on the dial. This wedge 44 defines a horizontal support plane and is intended to support the substrate 10 carrying the antenna circuits. This wedge may have a circular or semi-circular shape and defines a constant thickness determined above the dial.

The substrate 10 of the antenna device 1 is arranged to be positioned on the wedge 44, its first plate resting against the bearing plane formed by the wedge. Its connection part 100 is bent to position itself vertically, along a plane transverse to the mean plane (P).

A first wedging element 45, for example made of insulating foam, can be positioned between the substrate and the bezel surmounting the middle part.

A second element 46, for example made of insulating plastic, for example of semi-annular shape, includes a high part bearing against the upper face of the substrate 10, a vertical part extending downwards, to the dial and a lower part resting against the dial.

A touch screen 47, for example of the capacitive type, can be fixed under the glass 42, over a major part of the surface of the glass, separated from said second element 46 by air.

To fix the bracelet 49, the timepiece has on either side of its middle part, two horns 48 each arranged to fix a separate strand of the bracelet 49.

The antenna device is multi-band to operate at least two communication circuits, which have different features in terms of frequencies, polarisation, gain and impedance.

For the impedance, the electronic control circuit 2 may include a radiofrequency duplexer/notch filter 20.

For the gain and the polarisation, it is the pattern of each antenna circuit 11, 12 which allows to manage these parameters.

The use of a duplexer/notch filter isolates the two communication circuits (Bluetooth and GPS for example).

Such an antenna device is configured to simultaneously communicate signals of different polarities. For example, it should be noted that a Bluetooth-type communication circuit requires linear polarisation while a GPS-type communication circuit requires circular polarisation. The GPS system imposes in particular a polarisation called left polarisation.

Moreover, the solution of the invention allows to take into account the fact that the timepiece 4 includes a middle part 40 made of a metallic material.

According to a particular aspect of the invention, the antenna device 1 is intended to be placed as high as possible in the case of the timepiece, that is to say as close as possible to the glass, while remaining hidden from the eyes of the user.

Moreover, the arrangement of the antenna device 1 in the case of the timepiece, allows to benefit from the metal middle part 40 of the timepiece, through which the antenna device 1 can transmit its radiation. The bezel 41, which can be made of a ceramic-type material, allows, in order not to damage the radiation, in particular laterally, by adding a material with a high dielectric, to increase the electrical length of the antenna and thus improve its performance in relation to its physical size.

The antenna device 1 being placed above the dial 43 which is also metallic, a volume mainly filled with air (thus improving the efficiency of the antenna) is provided above the antenna device. This metallic dial 43 also acts as a screen, making any modification to the construction below this dial partly transparent to the antenna device 1.

As previously mentioned, in this timepiece the bracelet 49 participates in carrying out the configuration of the enlargement of the radiation pattern of said antenna device 1. In this configuration, the radiation takes place through the middle part 40 and this bracelet 49 plays a notable role in terms of radiation. It can indeed be partially produced with several links 50 made of metallic material in order to enlarge the radiation pattern in the directions which would be attenuated by the wearer's wrist. Moreover, the electrical looping between the top and the bottom of the middle part (from horn to horn) via the metallic bracelet 49 can be avoided by integrating a non-metallic link 51 to the bracelet 49. The placement of this link is optimised to reach the expected specifications.

Figure 4:
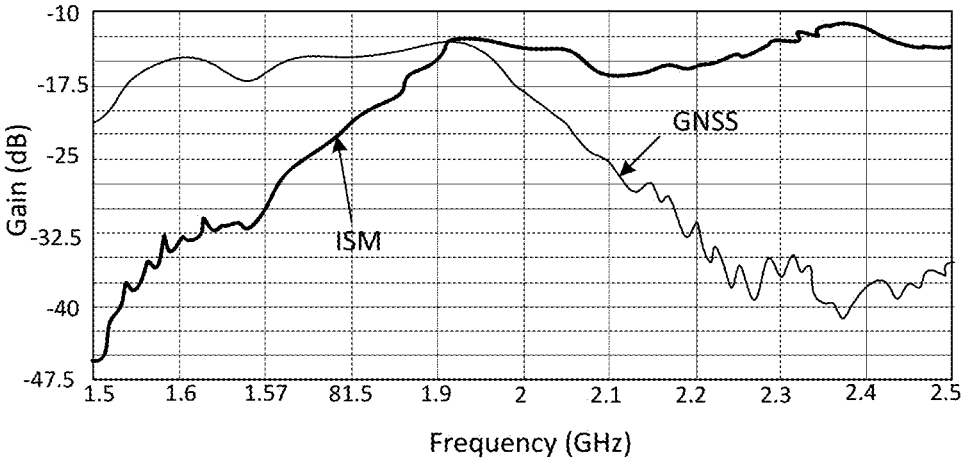
FIG. 4 shows a diagram illustrating the gain seen by each frequency band used in the communication system of the invention.

FIG. 4 illustrates the performance in terms of gain, seen by each of the frequency bands, the ISM (Industrial, Scientific and Medical—corresponding to the frequency band used by a network such as Bluetooth) band and the GNSS (Geolocation and Navigation by a Satellite System) frequency band, using the communication system of the invention.

Figure 5:
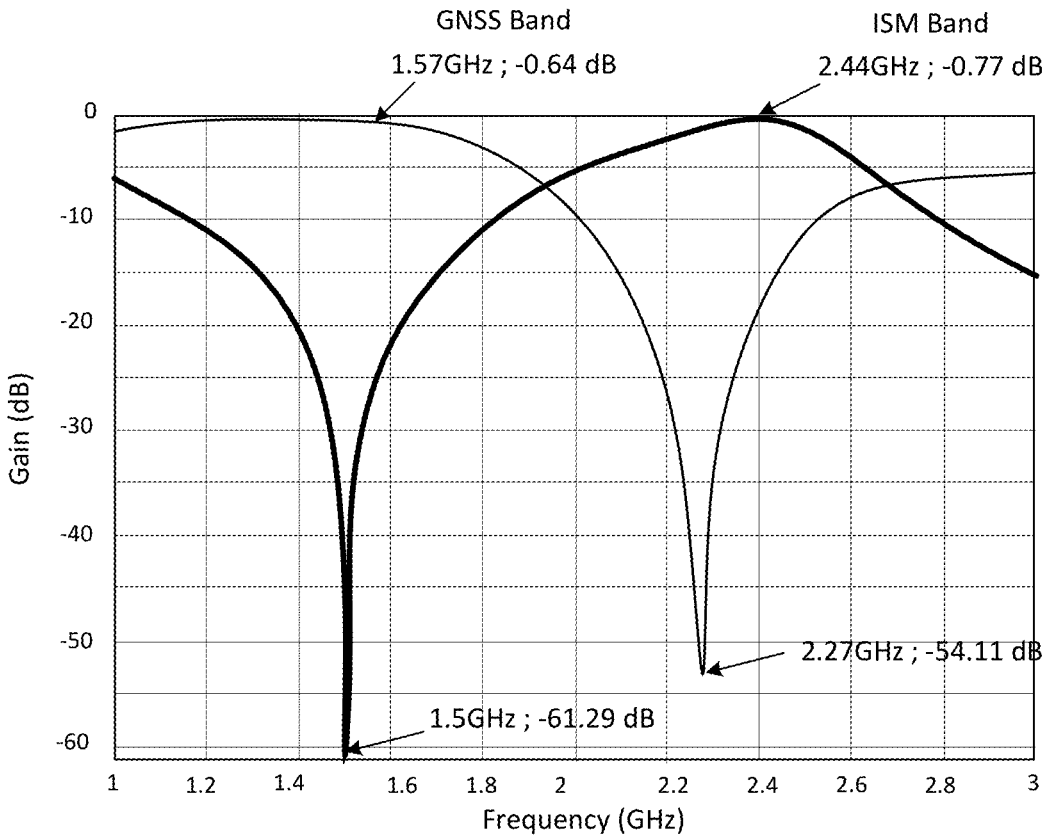
FIG. 5 shows a diagram illustrating the principle of isolation of the frequency bands allowed by the antenna device of the invention.

FIG. 5 shows two curves illustrating the separation of the frequency bands allowed by the use of the antenna device in accordance with the invention. It can be seen that the ISM band is well isolated from the GNSS frequency band.

Furthermore, such an invention thus participates in the production of a unique radiating structure of the miniature multiband type which uses the properties of the nearby materials (metal middle part, sapphire crystal) and in particular the bracelet with these fastening elements. This integration is made possible by a separation between the physical integration (the construction) and the antenna shape, thanks to a printing technique (PCB flex for example). This multiband structure is connected to the electronics through circuitry of the notch filter type.

It goes without saying that the present invention is not limited to the embodiment which has just been described and that various modifications and simple variants can be considered by the person skilled in the art without departing from the scope of the invention as defined by the appended claims.

The invention claimed is:

1. A timepiece comprising:

a case formed of a metal middle part wherein are disposed a metal dial and a remote communication system provided with a multi-band antenna device arranged above said dial, the communication system comprising a bracelet of said timepiece connected at its ends to said middle part and comprising a body formed of a plurality of fastening elements having different electrical conduction properties, said antenna device comprises:

a substrate, a first antenna circuit produced on said substrate and having first and second strands having a proximal end and a distal end, and extending in parallel between their proximal and distal ends, the first and second strands being connected by their proximal ends and separated at their distal ends, a second antenna circuit produced on said substrate and having third and fourth strands having a proximal end and a distal end, and extending in parallel between their proximal and distal ends, the third and fourth strands being connected by their distal ends and separated at their proximal ends, an electrical junction link joining the proximal ends of the first and third strands, and a connection part configured to be bent relative to said electrical junction link, and including a conductive connection connected to the electrical junction link and including an electromagnetic shielding of said conductive connection.

2. The timepiece according to claim 1, wherein the fastening elements comprise links which can each be made of metallic material or of dielectric material.

3. The timepiece according to claim 1, wherein the substrate includes a first plate having a face on which the first and second antenna circuits are made, said connection part being bent relative to said first plate.

4. The timepiece according to claim 1, wherein the fastening elements comprise a link made of dielectric material comprised in the body of the bracelet at one of its two ends.

5. The timepiece according to claim 1, wherein the first, second, third, and fourth strands are curved.

6. The timepiece according to claim 3, wherein the first plate of the substrate has a circular arc-shaped profile.

7. The timepiece according to claim 1, wherein first and second antenna circuits are disposed on opposite sides of said electrical junction link.

8. The timepiece according to claim 1, wherein the remote communication system comprises:

the antenna device, and a duplexer/notch circuit connected to said electrical junction link via the conductive connection of the connection part.

9. The timepiece according to claim 8, wherein said duplexer/notch circuit includes a first communication circuit configured to communicate according to a Bluetooth type protocol and a second communication circuit configured to communicate on a satellite positioning network via the first and second antenna circuits respectively.

10. The timepiece according to claim 1, wherein the timepiece is a connected watch.

11. The timepiece according to claim 1, wherein the antenna device is configured to simultaneously communicate signals of different polarities and/or signals of different frequency bands.

12. The timepiece according to claim 1, further comprising a wedge arranged on the dial, wherein the substrate is positioned on the wedge.

13. The timepiece according to claim 12, wherein the substrate is positioned on a top face of the wedge and the substrate is bent in a direction perpendicular to the top face of the wedge.

* * * * *